United States Patent [19]

Meijer

[11] 4,145,887

[45] Mar. 27, 1979

[54] SWASHPLATE COMPENSATION MECHANISM

[75] Inventor: Roelf J. Meijer, Eindhoven, Netherlands

[73] Assignee: U.S. Philips Corporation, New York, N.Y.

[21] Appl. No.: 802,907

[22] Filed: Jun. 2, 1977

Related U.S. Application Data

[63] Continuation of Ser. No. 623,734, Oct. 20, 1975, abandoned.

[30] Foreign Application Priority Data

Nov. 6, 1974 [NL] Netherlands ..... 7414457

[51] Int. Cl.[2] ..... F01B 29/10

[52] U.S. Cl. ..... 60/517; 74/60; 91/506; 92/12.2; 92/71

[58] Field of Search ..... 92/12.2, 13.1, 13.3, 92/71, 147; 91/505, 506; 417/269, 270; 60/517; 74/60

[56] References Cited

U.S. PATENT DOCUMENTS

| | | | |
|---|---|---|---|
| 3,106,057 | 10/1963 | Manning | 91/506 |
| 3,319,874 | 5/1967 | Welsh | 92/12.2 |
| 3,463,087 | 8/1969 | Grant | 92/12.2 |
| 3,575,534 | 4/1971 | Leduc | 91/506 |
| 3,733,963 | 5/1973 | Kubilos | 91/506 |

FOREIGN PATENT DOCUMENTS 65813 1/1943 Netherlands.

*Primary Examiner*—Abraham Hershkovitz
*Attorney, Agent, or Firm*—David R. Treacy

[57] ABSTRACT

A spring compensation mechanism for a swashplate drive having a variable swashplate angle, particularly suited for use with ahot gas engine. A compensating rod has one end connected for movement in one direction in response to tilting of the swashplate while the other end is connected to move in a perpendicular direction against the force of a spring.

11 Claims, 3 Drawing Figures

SWASHPLATE COMPENSATION MECHANISM

This is a continuation, of application Ser. No. 623,734, filed Oct. 20, 1975 now abandoned.

BACKGROUND OF THE INVENTION

The invention relates to a swashplate compensation mechanism for a hot-gas reciprocating engine having at least three reciprocable piston-like members each connected by a driving rod and sliding member to a swashplate on a drive shaft, and more particularly to a compensation mechanism for an engine having a rotatably journalled shaft to which the swashplate is connected by a tilting shaft extending transversely to the center line of the shaft, and means for tilting the plate about the tilting shaft.

Hot-gas reciprocating engines of the above-mentioned type are known from the U.S. Pat. No. 3,511,102.

In such a known hot-gas reciprocating engine, a variation in the stroke of the pistons connected to the swashplate is effected by tilting the plate about the tilting shaft. This results in a variation of the supplied power in engines and in a variation of the cooling capacity in refrigerators.

During operation of a hot-gas reciprocating engine, a reaction torque always acts on the swashplate about the tilting shaft, tending to rotate the plate to a position perpendicular to the shaft. The reaction torque is directly proportional to the angle which the plate encloses with a plane perpendicular to the shaft and is substantially independent of the drive shaft rotational speed.

In controlling the power of these machines, the reaction torque either aids or counteracts the control torque, dependent on whether power is being increased or decreased.

In order to increase power, the plate must be moved against the reaction torque; in order to to do this rapidly, much power is required, and in certain circumstances, is not available. To the contrary, when decreasing engine power, reaction torque aids the control torque, so there is excessive control power. This excessive control power should preferably be stored temporarily so that it can be used afterwards.

SUMMARY OF THE INVENTION

It is the object of the invention to provide a swashplate control mechanism for a hot-gas reciprocating engine of the kind described above which can be controlled rapidly and with little power.

According to the invention the swashplate is also coupled to a spring mechanism which exerts a torque on the plate that counteracts the reaction torque exerted on the plate by the pistons for all tilting angles.

Upon reduction of the engine power level a quantity of energy will be stored in the spring mechanism, which energy can be used to vary the position of the plate when increasing engine power. As a result engine power control can be carried out rapidly and with little control power. The spring mechanism may comprise both mechanical and gas spring constructions.

In a preferred embodiment of the invention the spring mechanism comprises at least one compensating rod whose ends are guided in two mutually perpendicular directions, one end being coupled to the swashplate and the other end being coupled to a spring having a spring constant at least substantially equal to the reaction forces acting on the plate by the piston-like members.

The rod of the spring mechanism in this construction is in force equilibrium (balanced) in any position. When the position varies, transport of energy will take place from the spring-like combination of pistons, connecting means and swashplate which acts on one end of the rod to the spring coupled to the other end of the rod. The spring-like combination which co-operates with one end of the rod has as it were a negative spring characteristic, because increased tilting in opposition to the reaction force reduces the reaction force.

In a further preferred embodiment the spring mechanism comprises at least one pair of identical rods which are pivotally coupled together at one end which is coupled to the plate, the free ends of the two rods being straight-guided in the same direction and each coupled to a respective spring, or conversely. The spring constant of the two springs together is substantially equal to the spring constant of the reaction forces acting on the plate from the piston-like members.

According to a still further hot-gas reciprocating engine embodiment of the invention two structural components are slidably guided along the shaft, one of said components being coupled to a point on the swashplate located to one side of the tilting shaft, and the other component being coupled to a point on the plate located on the other side of and equally distant from the tilting shaft, the two structural components being coupled together by at least two pivotally connected compensating rods of equal length. A spring acts on each of the pivots between two compensating rods, the spring constant of all the springs together being substantially equal to the spring constant of the gas forces acting on the plate from the pistons.

In this manner a balanced mechanical coupling is obtained between the spring mechanism and the swashplate, which coupling provides good force balancing so long as centrifugal forces do not become large in comparison with the other forces. Advantageously, the coupling between the plate and the spring mechanism is provided by one or more liquid columns.

Such a hydraulic coupling allows the spring mechanism to be arranged separately from the driving mechanism.

In a still further preferred embodiment according to the invention, each of the springs is supported at its end remote from the compensating rod mechanism by an element which can be moved in the direction of the spring, the spring mechanism and swashplate connected thereto being moved by displacement of each of said elements, the spring constant of all the springs together differing slightly from the spring constant of the gas forces acting on the plate from the pistons. By a displacement of said elements, a movement of the spring mechanism and the swashplate coupled thereto takes place.

According to a yet another preferred embodiment, the movable elements are hydraulic pistons so that the engine can be controlled hydraulically. To permit the swashplate to return automatically to the position perpendicular to the drive shaft when the shaft is stationary, the hydraulic piston cylinders may have a small bleeding aperture so that residual gas forces will cause the swashplate to pivot toward the perpendicular.

BRIEF DESCRIPTION OF THE DRAWINGS

The invention will now be described in greater detail with reference to the drawing, in which.

DESCRIPTION OF THE PREFERRED EMBODIMENT

Figure 1:
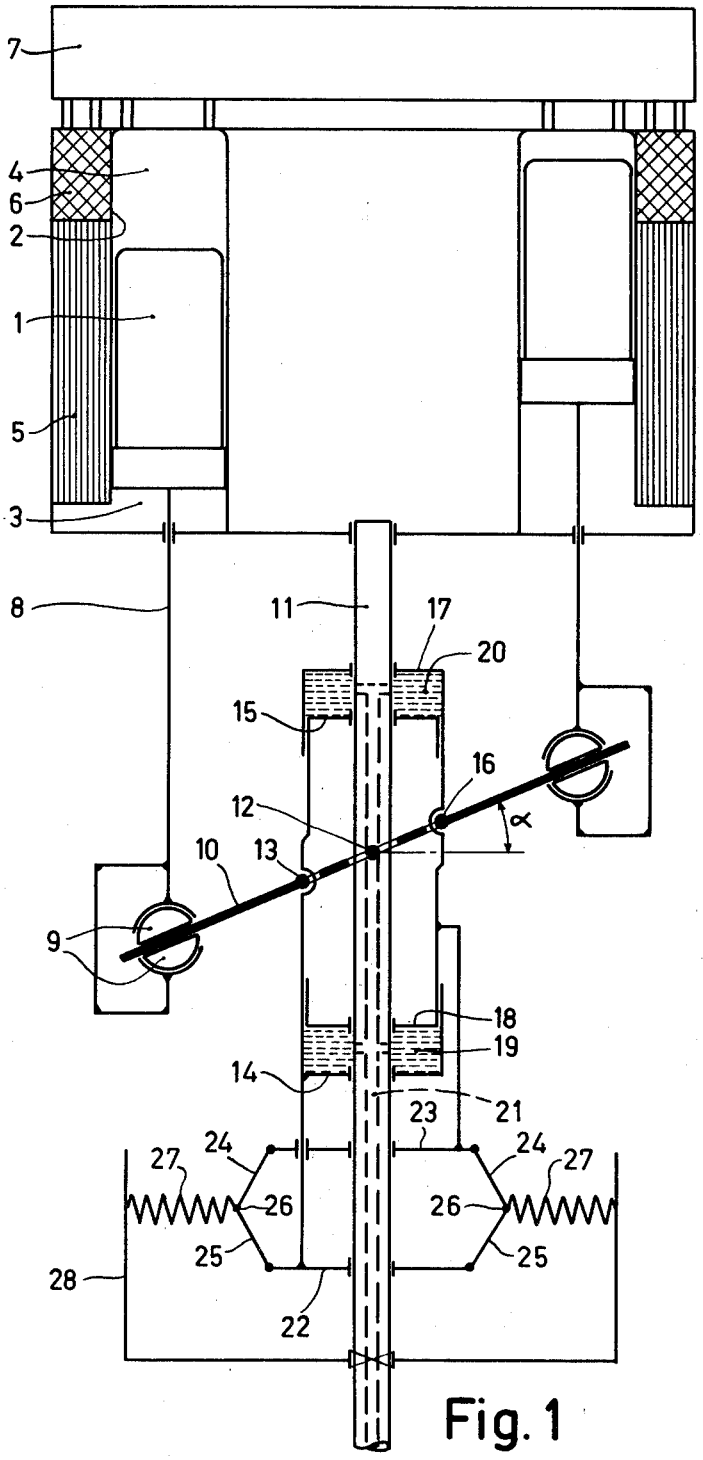
FIG. 1 is a diagrammatic cross-sectional view of a hot-gas engine having a swashplate driving mechanism.

The hot-gas engine shown in FIG. 1 comprises at least three, double acting pistons 1 which reciprocate in cylinders 2. Below each of the said pistons there is a cold compression space 3 while above each of the pistons there is a hot expansion space 4.

A number of units each comprising a cooler 5 and a regenerator 6 are arranged between the cylinders 2, each unit communicating on its cooler side with one cold space 3 in one of the cylinders 2 and on its regenerator side with a warm space 4 in another cylinder 2 through a heater 7. In this manner a double-acting hot-gas engine is obtained which is described in detail in Dutch Patent Specification No. 65813, to which U.S. Pat. No. 2,480,525 corresponds, so that further explanation need not be given.

Each of the pistons 1 has a driving rod 8 which is coupled to a swashplate 10 by sliding members 9.

The swashplate 10 is connected to a drive shaft 11 such that it rotates with the shaft 11 and can also tilt about a tilting shaft 12 perpendicular to the drive shaft.

For moving the swashplate 10 about the tilting shaft, at a locating 13 to one side of the shaft 12 the plate is pivotally connected to a pair of pistons 14–15, and at a location 16 symmetrically arranged on the other side of the tilting shaft the plate 10 is similarly connected to a pair of pistons 17–18.

The pistons 14 and 18 are arranged to one side axially of the plate 10 to define a space 19 between the pistons, while the pistons 15–17 similarly define a space 20 on the other side of the plate 10.

A duct 21, shown as a passageway in the shaft 11 communicates with a device (not shown) by which liquid can be supplied to or removed from the spaces 19 and 20.

The construction and operation of this system to cause the plate to tilt is further described in detail in applicant's prior Dutch Patent application No. 74 105 32, to which U.S. Pat. No. 4,030,404 issued June 21, 1977 corresponds.

During operation of hot-gas engines a gaseous working medium under high pressure is present in the spaces 3 and 4 and the ducts therebetween, which medium reciprocates between the cold and warm spaces as a result of the movements of the pistons.

The gas forces exerted on the pistons are transferred to the swashplate 10 by the driving rods 8 and the sliding members 9. Said reaction forces exert on the plate 10 a torque which tries to force the plate 10 to a position normal to the shaft. Said torque varies substantially linearly with the angle $\alpha$ and is zero when $\alpha = 0$ and is maximum when $\alpha$ is a maximum for example, 22°.

In order to control the supplied power of the engine, the plate 10 must be moved either against the torque or with the torque. In one case this will require power, whereas in the other case an excess of power is released.

According to the invention plate 10 is balanced in any position, so at any angle $\alpha$, movement in one direction or in the other neither requires nor releases power.

This is achieved by connecting the pair of pistons 14–15 through a structural component 22 which is axially slidably connected to the shaft 11, to a spring mechanism while piston pair 17–18 is connected through a structural component 23 which is also axially slidable on the shaft 11 to the same mechanism.

The structural components 22 and 23 are interconnected by pivotal coupling to respective one ends of one or more pairs of rods 24–25, each pair being pivotally coupled together at their other ends at a respective point 26, at which point one end of a spring 27 is connected, the other end of each respective spring bearing against a spring dish 28 which is rigidly secured to the shaft 11.

The springs 27 are constructed so that together they show a spring characteristic which is equal to the characteristic of the forces exerted on the structural components 22 and 23 by the piston pairs 14–15 and 17–18.

In this manner a compensation mechanism is obtained in which upon moving the plate 10 to its position at right angles to the shaft, the structural components 22 and 23 move towards each other so that the springs 27 are compressed and the energy delivered by the plate 10 is thereby stored in said springs. The energy stored in the springs 27 may afterwards be used to move the plate 10 in the opposite direction.

The compensation mechanism may be compared with a diamond in the corners of which four identical springs engage, opposite corners moving co-linearly in opposite directions. It can be proved theoretically that such a diamond is balanced in any position.

This means that the hydraulic liquid which upon moving is supplied to or withdrawn from the spaces 20, 19 through duct 21, need not do any movement work (not counting friction), so that the hot-gas engine can hence be controlled very rapidly.

Figure 2:
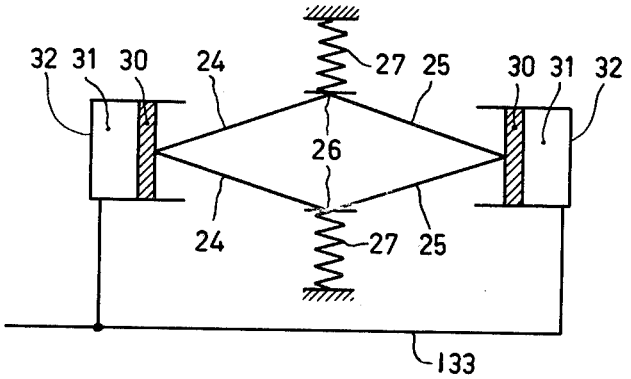
FIG. 2 shows diagrammatically an example of a compensation mechanism.

Instead of a hydraulic system for moving the plate, mechanical means may also be used for this purpose, if desired. Due to the direct coupling of the piston pairs 14–15 and 17–18 with the compensation mechanism, the latter must necessarily also rotate with the shaft 11. At high rotational speeds, such large centrifugal forces may occur. As a result, the compensation effect is adversely influenced. In order to avoid this, a hydraulic coupling may be provided between the swashplate 10 and the compensation mechanism. It is further clear that four rods 24 and 25, and two springs 27 are not required to provide a force-balanced compensating mechanism. As described in the Summary of the Invention, the free ends of the rods 24 connected to the springs 27 may be guided in a straight line perpendicular to the direction of movement of the structural component 23 (FIG. 1) or the piston 30 (FIG. 2). In this case the springs 27 each have the same spring constant as in the four-rod embodiment; only the guides must be supplied to counteract the side thrust of the rod free ends.

Still further, force balancing (but without the initial balancing which is desirable if the compensation mechanism rotates with the shaft) is possible with only one rod 24 and one spring 27. In this case, the one spring has a constant (force per unit distance compressed) equal to the total of the two springs shown, and guiding of the two rod ends along mutually perpendicular directions is required. These guides may be of any type well known in the art.

With hydraulic couplings, a compensation mechanism as shown in FIG. 2 may be used. This includes a diamond of four pivotally connected rods 24–25. Two opposite corners 26 of said diamond are each connected to a spring 27. The two other corners are each connected to a piston 30 which bounds one end of a space 31 in a cylinder 32. Each of the spaces 31 communicates with the duct 21 through a pipe 133. To control engine power by moving the plate, a separate hydraulic system or mechanical means may be used.

The construction is proportioned so that the characteristic of the springs corresponds at least substantially with the variation of the forces exerted by the pistons 30 when the pistons move.

When moving the swashplate 10, the volume of the spaces 20 and 19 will vary. This means that the liquid column between the spaces and the pistons 30 moves so that the pistons 30 experience a displacement. When the plate 10 assumes a more inclined position, the pistons 30 will move apart and, conversely, when moving to the position normal to the shaft, the pistons move towards each other. The forces exerted by the pistons 30 vary proportionally with the variation of the angle $\alpha$. By giving the springs 27 a characteristic which corresponds to the forces characteristic, the rod diamond 24, 25 is balanced in any position. This means to displace the diamond and plate 10 connected thereto only negligible forces are necessary so that the displacement can be carried out very rapidly. The displacement should be carried out hydraulically or mechanically with a separate mechanism.

Figure 3:
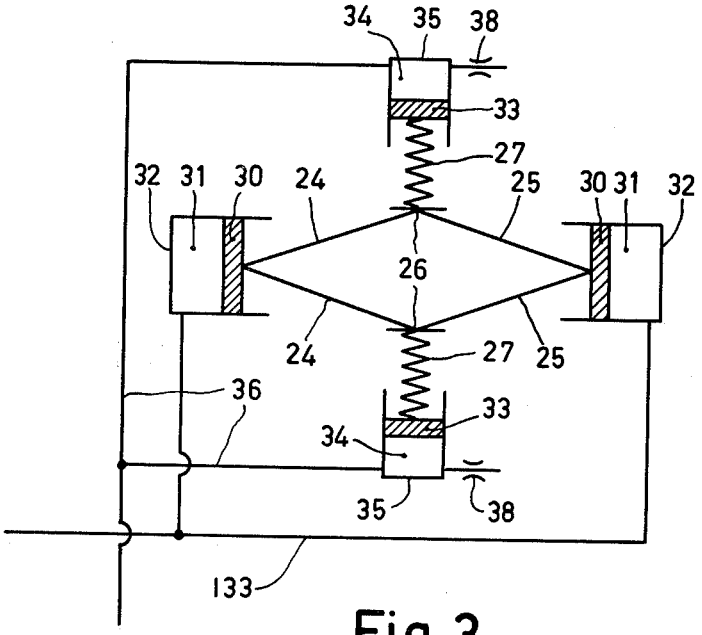
FIG. 3 shows diagrammatically another embodiment in which the compensation mechanism is also combined with a displacement mechanism.

FIG. 3 shows diagrammatically another embodiment in which the compensation mechanism is also combined with a displacement mechanism.

The compensation mechanism comprises the same components as that of FIG. 2. The only difference in this case is that the springs 27 are connected to pistons 33 which bound a space 34 in a cylinder 35. Furthermore, the spring characteristic of the springs 27 has now been chosen to be slightly different from the force characteristic exerted by the pistons 30.

When, by supplying liquid via ducts 36 the pistons 33 are moved, the prestress of the springs 27 varies thereby and the rod diamond 24, 25 is unbalanced. As a result of this the pistons 30 will be displaced until a new equilibrium state is reached.

In order to ensure that, with the engine stationary, the gas forces can force the plate 10 to its position normal to the shaft, each of the cylinders 35 has a narrow bleeder aperture 38 through which liquid can leak, so that in the stationary condition the liquid can flow away from the spaces 34. The pistons 33 will then apart as a result of which inbalance of the diamond rod causes the pistons 30 to move towards each other so that the plate 10 moves to its position normal to the shaft.

From the above it is clear that the above-described invention provides a hot-gas engine having a variable angle swashplate driving mechanism which is coupled to a compensation mechanism that balances the plate in any position so that the displacement can be carried out without work and hence very rapidly.

In the embodiments the springs are shown as being ordinary mechanical springs; it will be obvious, however, that the springs may also be formed by any other kind of springs, such as a gas spring formed by a piston supported by a gas buffer. It is further clear that four rods 24 and 25, and two springs 27 are not required to provide a force-balanced compensating mechanism. As described in the Summary of the Invention, the free ends of the rods 24 connected to the springs 27 may be guided in a straight line perpendicular to the direction of movement of the structural component 23 (FIG. 1) or the piston 30 (FIG. 2). In this case the springs 27 each have the same spring constant as in the four-rod embodiment; only the guides must be supplied to counteract the side thrust of the rod free ends.

Still further, force balancing (but without the initial balancing which is desirable if the compensation mechanism rotates with the shaft) is possible with only one rod 24 and one spring 27. In this case, the one spring has a constant (force per unit distance compressed) equal to the total of the two springs shown, and guiding of the two rod ends along mutually perpendicular directions is required. These guides may be of any type well known in the art.

What is claimed is:

1. A spring compensation mechanism for a swashplate drive, said drive including a drive shaft mounted for rotation about its center line, a tilting shaft extending transversely to the center line of the drive shaft, a swashplate tiltably mounted about said tilting shaft and coupled to said drive shaft for rotation therewith, a plurality of driving rods mounted for reciprocating movement relative to said drive shaft, said drive rods being coupled to said swashplate such that, the swashplate being tilted at an oblique angle with respect to the drive shaft center line, driving force exerted by said rods against said swashplate imparts rotational torque to said swashplate for rotating said drive shaft, said force also tending to tilt said swashplate toward a position perpendicular to said center line, and means for tilting said swashplate about said tilting shaft, wherein said mechanism comprises at least one compensating rod having two ends; means for coupling one end of said compensating rod to the swashplate and for guiding said end for movement in a first direction in response to tilting of said swashplate, means for guiding the other end of said rod for movement in a direction transverse to said first direction, and a spring coupled to said other end and arranged to be resiliently stressed by movement of said rod other end in response to tilting of the swashplate, the orientation of said spring being such that deflection of the spring is proportional to movement of said rod other end, the spring constant being such that stressing of the spring produces a change in force proportional to the force change caused by the tendency of said driving rods to tilt said swashplate toward said perpendicular position.

2. A mechanism as claimed in claim 1, having a pair of said compensating rods of equal length pivotally coupled at respective said one ends, respective said other ends being guided for co-linear movement in opposite directions and coupled to free ends of respective springs, the spring constant of the springs together being substantially equal to the spring constant of the force tending to tilt the swashplate toward said perpendicular position.

3. A mechanism as claimed in claim 1, having two compensating rods having respective said other ends pivotally connected together, wherein said means for coupling comprises first and second components guided for axial movement parallel to said drive shaft, the first component coupled to the swashplate at a location to one side of the tilting shaft and the second component coupled to the swashplate at a location to the other side of the tilting shaft so that said components move in opposite directions for a given tilting movement, respective components being each pivotally connected to a respective one end of a compensating rod.

4. A mechanism as claimed in claim 3 wherein said locations are equidistant from the tilting shaft, comprising at least four compensating rods of identical length pivotally connected to constitute a diamond of rods, two opposite pivots being connected to respective components, the other pivots being each connected to a respective spring, the spring constant of the springs together being substantially equal to the spring constant of the force tending to tilt the swashplate toward said perpendicular position.

5. A mechanism as claimed in claim 1, having two compensating rods having respective said other ends pivotally connected together, wherein said means for coupling comprises first and second components guided for axial movement parallel to said drive shaft, the first component coupled to the swashplate at a location to one side of the tilting shaft and the second component coupled to the swashplate at a location to the other side of the tilting shaft so that said components move in opposite directions for a given tilting movement, and single liquid duct means for moving said respective one ends in response to movement of said components with respect to each other.

6. In a hot gas reciprocating engine comprising a drive shaft mounted for rotation about its center line, a tilting shaft extending transversely to the center line of the drive shaft, a swashplate tiltably mounted about said tilting shaft and coupled to said drive shaft for rotation therewith, a plurality of piston-like members, a corresponding plurality of driving rods mounted for reciprocating movement relative to said drive shaft, said driving rods being coupled to said swashplate such that, the swashplate being tilted at an oblique angle with respect to the drive shaft center line, driving force exerted by said rods against said swashplate imparts rotational torque to said swashplate for rotating said drive shaft, said force also tending to tilt said swashplate toward a position perpendicular to said center line, and means for tilting said swashplate about said tilting shaft, a spring compensation mechanism comprising two compensating rods each having one end and an other end, said other ends pivotally connected together; means for coupling said one ends of said compensating rods to the swashplate and for guiding said one ends for movement in a first direction in response to tilting of said swashplate, said coupling means comprising first and second components guided for axial movement parallel to said drive shaft, the first component coupled to the swashplate at a location to one side of the tilting shaft and the second component coupled to the swashplate at a location to the other side of the tilting shaft so that said components move in opposite directions for a given tilting movement, means for coupling said components to move said one ends toward each other in response to tilting of the swashplate toward the perpendicular position;

means for guiding said other ends of said rods for movement in a direction transverse to said first direction; and a spring coupled to said other end and arranged to be resiliently stressed by movement of said rod other end in response to tilting of the swashplate, the spring constant and orientation of said spring being such that stressing of the spring produces a change in force proportional to the force change caused by the tendency of said driving rods to tilt said swashplate toward said perpendicular position.

7. An engine as claimed in claim 6, wherein said locations are equally distant from the tilting shaft, comprising at least four compensating rods of identical length pivotally connected to constitute a diamond of rods, two opposite pivots being pivotally connected to said respective components, the other pivots being each connected to a respective spring, the spring constant of the springs together being substantially equal to the spring constant of the force tending to tilt the swashplate toward said perpendicular position.

8. An engine as claimed in claim 6, wherein said means for coupling said components includes single liquid duct means for moving said respective one ends in response to movement of said components with respect to each other.

9. An engine as claimed in claim 8, comprising at least four compensating rods of identical length pivotally connected to constitute a diamond of rods, means connected to said single liquid duct means for moving two opposite pivots in said first direction, the other pivots being each connected to a respective spring, the spring constant of the springs together being substantially equal to the spring constant of the force tending to tilt the swashplate toward said perpendicular position.

10. An engine as claimed in claim 6, wherein said spring mechanism includes a plurality of springs, each of said springs at an end remote from said compensating rods being supported by an element which can be moved in the direction of the spring; and means for displacing said spring mechanism and tilting said swashplate by displacing each of said elements, the spring constant of all the springs together differing slightly from the spring constant of the gas forces acting on the plate by said pistons.

11. An engine as claimed in claim 10, wherein each of said elements includes means for displacing the respective spring responsive to supply and removal of liquid from a space; and said elements further include a bleeding aperture connected to said space through which liquid can flow away from the space.

* * * * *